United States Patent [19]

Eirich et al.

[11] Patent Number: 4,569,025

[45] Date of Patent: Feb. 4, 1986

[54] METHOD OF PREPARING FOUNDRYS AND BY MEASURING MOISTURE AND COMPRESSIBILITY

[76] Inventors: Paul Eirich, Bahnhofstrasse 11; Hubert Eirich, Sandweg 16; Walter Eirich, Spessartweg 18, all of 6969 Hardheim, Fed. Rep. of Germany

[21] Appl. No.: 494,234

[22] Filed: May 13, 1983

[30] Foreign Application Priority Data

Jun. 2, 1982 [DE] Fed. Rep. of Germany ..... 3220662

[51] Int. Cl.[4] ..... G06G 7/58; B28C 7/04

[52] U.S. Cl. ..... 364/502; 364/154; 366/8; 366/16; 366/132; 366/160

[58] Field of Search ..... 364/154, 502; 366/132, 366/6, 8, 16, 160

[56] References Cited

U.S. PATENT DOCUMENTS

| | | | |
|---|---|---|---|
| 3,473,008 | 10/1969 | Bay et al. | 364/502 |
| 3,519,252 | 7/1970 | Dietert et al. | 366/8 |
| 3,609,316 | 9/1971 | Brosset et al. | 364/502 |
| 3,751,644 | 8/1973 | Mayer | 364/502 |
| 3,959,636 | 5/1976 | Johnson et al. | 364/502 |
| 4,318,177 | 3/1982 | Rapp et al. | 364/502 |
| 4,363,742 | 12/1982 | Stone | 366/132 |
| 4,403,866 | 9/1983 | Falcoff | 366/132 |

*Primary Examiner*—Jerry Smith
*Assistant Examiner*—John R. Lastova
*Attorney, Agent, or Firm*—Biebel, French & Nauman

[57] ABSTRACT

A method of preparing foundry sand by measuring moisture and compressibility includes the steps of determining a set of desired characteristics for compressibility and for moisture in accordance with a particular clay content, measuring the actual compressibility in a first stage early in the processing of the foundry sand, adding moisture in accordance with the difference between the moisture for the measured compressibility and the moisture for the desired compressibility to bring the foundry sand to a predetermined value in accordance with the assumed set of characteristics, making a second measurement of the compressibility in a second stage as a countercheck near the conclusion of the processing, measuring the difference between the actual compressibility at the second stage and the desired compressibility, and employing such difference as a correcting value to adjust the calibration of the first measuring stage. If the actual compressibility measurement at the second stage is found to be out of range of predetermined maximum-minimum limits, a dosing computer adds additives such as fresh sand, clay and coal dust, and/or filtered dust in amounts calculated to bring the sand back into such range.

6 Claims, 4 Drawing Figures

METHOD OF PREPARING FOUNDRYS AND BY MEASURING MOISTURE AND COMPRESSIBILITY

BACKGROUND OF THE INVENTION

The invention relates to a method of automatically controlling installations for the preparation of foundry sand, wherein the moisture and compressibility of the sand are measured.

When clay-bonded foundry sand has been used, i.e. cast, it is generally returned to a preparation installation, where the sand is remixed with an adequate quantity of water, bonding agent (e.g. Bentonite), additive (e.g. coaldust, starch) and fresh sand.

The purpose is to proportion the various additives so that the foundry sand has a uniform quality. However, the strain on the foundry sand (e.g. the thermal strain, loss of sand) fluctuates according to each particular production programme, so that old foundry sand with fluctuating properties or different sand characteristics is constantly being recycled to the preparation plant. The aim of a well-functioning preparation process is therefore always to recognise the fluctuations in the old sand and to incorporate the additive with appropriate differentiation during the mixing process.

It is already known to measure the moisture of the foundry sand prior to mixing or in the mixer, and preferably to take the temperature simultaneously. A combined measuring system is also known, where the moisture and density of the sand are measured in the mixer on a capacitative basis at the beginning of the mixing time. It is true that with both these systems premature measurement can be obtained, i.e. measurement prior to mixing or at least at the beginning of the mixing period, so that the moisture content of the sand can still be corrected in a relatively simple way during the mixing period. The first-mentioned, moisture only measurement, however, has the disadvantage that only moisture is measured as the sole variable, and the other fluctuations or variables in the old foundry sand are not taken into account. The second mentioned, combined measuring system does indeed take into account not only the moisture of the sand but also its compressibility and deformability, which again are connected to the piled weight; but it has the disadvantage that the measuring instrument has to be readjusted if there is any change in the characteristic of the sand. It will be appreciated that this necessitates time consuming measures.

Other systems are known, where the compressibility and/or deformability of the sand is ascertained either during the mixing period, by taking samples from the mixer, or after mixing. This measuring method does indeed give direct results for some property of the sand which is important to the processor. The disadvantage, however, is that correction of the addition of water during the mixing period must lengthen the period, since the water is added in stages and each addition has to be mixed in before any new measurement can be taken.

All known systems and processes suffer from the disadvantage that, although it may be possible to establish the compressibility of the sand, the causes of changes in compressibility cannot be ascertained.

SUMMARY OF THE INVENTION

The invention therefore aims to provide a method of the above type, whereby the causes of the changing compressibility are ascertained and it is possible to recalibrate to take these causes into account.

According to the invention this aim is achieved, in that for a predetermined sand characteristic a desired value is stipulated both for compressibility and for moisture of the sand; the actual value for compressibility is measured in a first stage and brought to the desired compressibility by changing the moisture; then the actual value for compressibility is remeasured in a second stage as a counter check; and the difference between the compressibility last ascertained and the desired compressibility is used as a correcting value to adjust a straight calibration line of the first measuring stage for the first actual value measurement. In this way indications of the causes leading to a change in the measured compressibility of the sand are obtained, and an automatic control circuit is provided even for changing properties of the sand. This is achieved substantially through two simple measuring stages, with any difference in measurement which may be found being used as a correcting factor to adjust the first measuring stage. In this way the measuring process is automatically adapted to shifts in the composition of the sand.

It is particularly desirable for the first measuring stage to be at the beginning of the mixing process and the second towards the end. The moisture content of the foundry sand which has just been measured and is being treated may have changed in the interim.

It is found in practice that, after this change in the moisture of the sand to the desired value, the last actual moisture, after the second or third measurement by the method of the invention at the latest, is near the desired value. As a general rule the straight calibration line, which is known per se, is therefore adjusted during the first measuring stage, at the beginning of operation in the first batches. In theory, however, any difference found will in fact take effect only for the next batch, because the second measuring stage comes towards the end of the mixing process; this is a measure which has proved thoroughly successful in practice, however, since the change in the composition of the sand is not generally abrupt but rather a tendency which can be recognised in good time.

In an advantageous further embodiment of the invention the straight calibrating line is allowed to shift within a predetermined tolerance range during the first stage. The straight measuring line refers to the substantially rectilinear dependency between the compressibility of the water content of the foundry sand and a particular characteristic of the sand, preferably its clay content. This straight calibration line may shift according to the characteristic of the sand. If this tolerance range is stipulated, then according to the invention the difference found when the range is exceeded is used to dose other individual components of the mix differently upstream of the mixer or to correct the dose set for them, so that the composition of characteristic of the sand is taken back to the desired value or at least brought within the tolerance range again.

In accordance with the invention it is desirable for the tolerance range for shifting the calibration line to be determined by the clay content of the sand. This is a physical fact which is known per se, but in conjunction with the invention it provides an evaulation for the correcting steps. In other words, the clay content of the sand has been found to be a particularly important parameter, and if this can be corrected automatically the desired aims will already have been largely achieved.

As mentioned briefly above, it may be particularly advantageous according to the invention for a measurement to be transmitted to dosing computers for the addition of fresh sand, additive and the like when the tolerance range is exceeded. It is true that with an operational plant the stipulated tolerance range is generally set and stipulated at a reasonable level as an experimental value, so that the range is not generally exceeded. In exceptional cases, however, and with unusual loads on the foundry sand, appropriate correction of the dosing may become necessary. With the measures according to the invention this can be controlled automatically as described above.

Other advantages, features and applications of the invention will emerge from the following description in conjunction with the accompanying drawings.

DESCRIPTION OF THE PREFERRED EMBODIMENT

Figure 1:
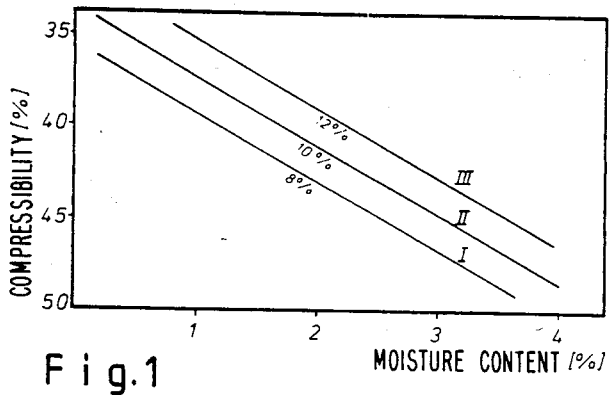
FIG. 1 is a diagrammatic graph showing the correlation (known per se) between the compressibility of foundry sand and its moisture content, with different clay contents.

The deformability of sand is directly connected to the piled density (in kg/l) or compressibility (in %) and is a very important value for the foundry expert. In FIG. 1 the dependence of compressibility, as a percentage, on moisture content, expressed as % of water, is shown as a diagrammatic example. There may for example be a straight calibration line I for a clay (Schlämmstoff) content of 8%, a line II for a clay content of 10% and a line III for a clay content of 12%. It will be seen how the line is transposed with the change in the clay content. In other words, larger water contents may e.g. be necessary as the clay content increases. Other information from the theory, that the curves become steeper as the clay content of the sand is reduced, need not be taken into account here, since they are not essential to an understanding of the invention.

Figure 2:
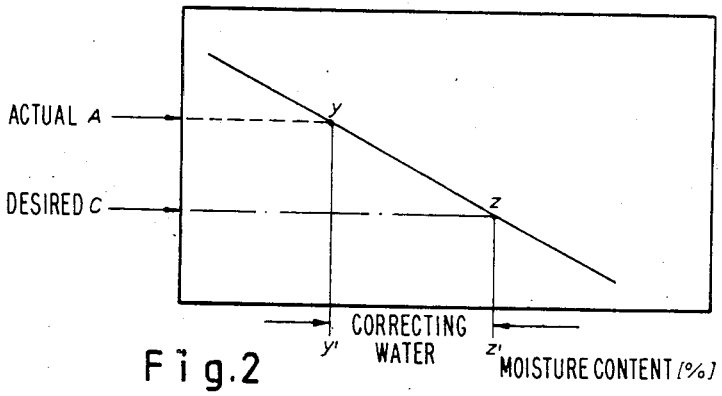
FIG. 2 shows a straight calibration line diagrammatically, with an actual value and a desired value.

In FIG. 2 one of the calibration curves has been picked out, in a graph of the same type, to explain the measures according to the invention. The point Z indicates the desired value on the straight calibration line, corresponding to the compressibility C as the desired value and the moisture content Z', expressing the percentage of water. If the actual value Y is found on the calibration line at the first measuring stage I, when measuring is begun, this goes together with the actual value A for compressibility and the actual value Y' for moisture content.

Figure 3:
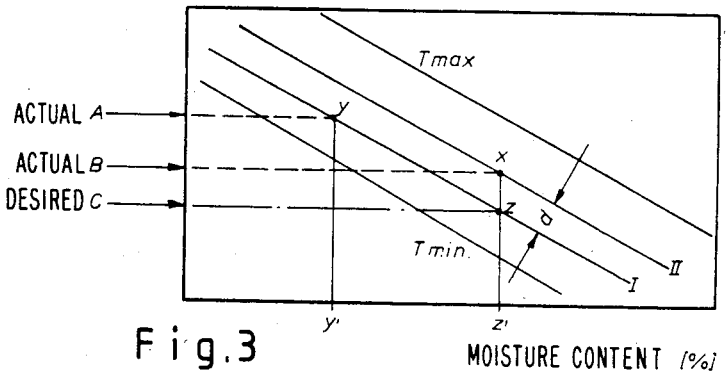
FIG. 3 is the same as FIG. 2 but also shows the tolerance range and the allowance made for the shift of the calibration line.
Figure 4:
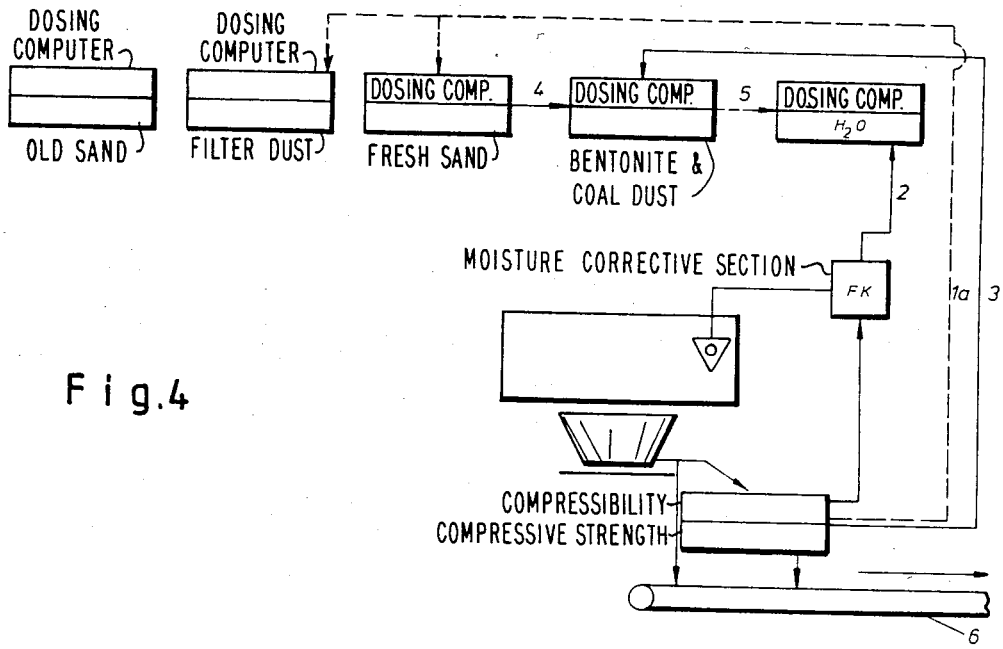
FIG. 4 is a diagram showing an installation for carrying out the method of the invention.

Referring to FIG. 4, a measurement signal is passed from the compressibility measuring stage, along the line 2 to the dosing computer. The computer contains the necessary correcting amount of water, ascertained in the moisture correction according to the graph in FIG. 2 or 3, as the difference between values Z'-Y'. If this amount of correcting water is added, then theoretically the actual value Z will have been reached on the calibration line as the desired value.

Owing to the different loading of the sand, however, the actual conditions are not so simplified and favourable. The clay content is picked out as the most essential change in the characteristic of the sand, resulting in a shift of the calibration line I in FIG. 3, e.g. to calibration line II.

The correcting step according to the invention is shown in FIG. 3 using the same diagrammatic graph. The desired value Z on the calibration line I is stipulated. If the actual value Y is measured on the calibration line I entered in the computer in the first measuring stage, this corresponds to a compressibility A and a moisture content Y'. The computer accepts the calibration line I as the correct one and determines the quantity between the value Z' and Y' as a correcting amount of water. When this amount of water has been added the mix is further processed so that the water is finally worked into the foundry sand. At the end of the mixing process or when the material has left the mixer, a counter-check is carried out in the mixed sand in a second measuring stage. If the value ascertained in the counter-check, i.e. in the second measuring stage II, is also at Z, then the calibration line is effectively the right one, since no correction is required. But if the actually measured value X differs from the value Z, it can be taken that the clay content of the sand may e.g. have changed from calibration line I to line II and the line may thus have shifted a distance d. A shift d thus ascertained is transmitted along line 1 to the moisture correcting section, and may be used to shift the calibration line the distance d in the measuring instrument carrying out the first measuring stage I. Independent control and adaptation to changes in the composition of the sand can advantageously be carried out by this method.

It will be seen from the FIG. 3 example that when the amount of correcting water Z'-Y' has been added the counter-check has given a value X which does not have the required target compressibility C, representing the desired value, but instead a value B. In effect the computer has calculated an erroneous quantity of correcting water at measuring stage I, and has incorrectly evaluated it via line 2 with the moisture correcting section FK by means of the dosing computer.

Only when the shift d has been ascertained and the equipment readjusted at measuring stage I can the amount of correcting water be correctly determined, so that the finally measured value X is the same as the value Z. Only then is the desired value for compressibility equal to the actual value.

The parallel calibration line at the bottom is defined as $T_{min}$ and that at the top as $T_{max}$. These are the predetermined tolerance limits for the sludge content of the foundry sand. If one of these limits is exceeded during the process according to the invention, then the calibration line is indeed readjusted up to that limit. At the same time, however, a corresponding measurement is transmitted to the dosing installation, e.g. along the line 1*a* for the dosing computer for the addition of filter dust or fresh sand or along the line 3 for the computer for bentonite and coal dust; this may be done on the basis of the compressive strength measured, as will be explained below. The quantities of fresh sand, binder or additive can then be automatically increased or appropriately reduced there.

The counter-check described can be carried out particularly advantageously with a measuring instrument which measures not only the compressibility of the sand but also its compressive or shearing strength. An instrument of this type for measuring compressive strength is indicated diagrammatically in FIG. 4 above the conveyor 6. The value obtained there at the second stage II may be transmitted e.g. along the line 3 to the dosing installation, so that an appropriate correction is made for bentonite and carbons or even additives. Where dosing computers are used, the addition of bentonite and additives may easily be corrected automatically, according to the measured strength of the sand, and an additional correction necessitated by the change in the addition of fresh sand may be carried out.

We claim:

1. The method of automatically controlling the preparation of foundry sand by measuring moisture and compressibility comprising the steps of:

establishing a straight line correlation between compressibility and moisture content for an assumed clay content, measuring the actual compressibility of the foundry sand in a first mixing stage, measuring the difference between the actual compressibility and the desired compressibility, adding moisture to said sand in accordance with the theoretical difference between the actual moisture and the calculated moisture for the desired compressibility along said line, subsequently in a second mixing stage remeasuring the compressibility as a countercheck and determining a second difference between the actual compressibility of the sand at the second stage and said desired compressibility, and applying said second difference to adjust said correlation of said first measuring stage in accordance with said second difference to account for an apparent shift in actual clay content of said sand from said assumed clay content.

2. The method of claim 1 comprising the further step of determining a predetermined maximum-minimum range for said line correlation, determining whether said compressibility as measured at said second stage falls outside of said range, and redosing said sand with fresh additives calculated to bring the measured compressibility at said second stage back within said predetermined range.

3. The method of claim 2 in which said predetermined range is determined as a percentage of the clay content of the sand.

4. The method of claims 2 or 3 in which said foundry sand is of the clay-bonded type and in which said additives include a clay bonding agent, coal dust, and fresh sand.

5. The method of claim 1 in which said second stage remeasurement also includes the measurement of compressive strength.

6. The method of preparing clay-based foundry sand from previously used sand comprising the steps of:

predetermining a set of initial desired characteristics for sand compressibility and moisture in accordance with an assumed clay content, measuring the actual compressibility in a first mixing stage early in the processing of the foundry sand, adding moisture to the sand in accordance with the different between the predetermined moisture for the measured compressibility and the moisture for the desired compressibility in accordance with said set of characteristics, remixing said sand and making a second measurement of compressibility in a second stage as a countercheck near the conclusion of processing and determining a second difference between the compressibility at said second stage and the said desired characteristics for compressibility, and adjusting the value of said set of characteristics in accordance with second difference to account for an apparent difference in actual clay content from said assumed clay content.

* * * * *

UNITED STATES PATENT AND TRADEMARK OFFICE

CERTIFICATE OF CORRECTION

PATENT NO. : 4,569,025

DATED : February 4, 1986

INVENTOR(S) : Paul Eirich, Hubert Eirich, and Walter Eirich

It is certified that error appears in the above-identified patent and that said Letters Patent is hereby corrected as shown below:

On the title page:
In the Title [54]: Change "foundrys and" to -- FOUNDRY SAND --.

Claim 6, Col. 6, line 26, "different" should be -- difference --.

Signed and Sealed this

*First* Day of *July 1986*

[SEAL]

*Attest:*

DONALD J. QUIGG

*Attesting Officer*

*Commissioner of Patents and Trademarks*